United States Patent [19]

Lenz

[11] 4,015,685

[45] Apr. 5, 1977

[54] APPARATUS FOR ALIGNING A MOBILE LIFT WORK PLATFORM

[75] Inventor: Leonard L. Lenz, Greenville, S.C.

[73] Assignee: American Mobile Corporation, Greenville, S.C.

[22] Filed: June 16, 1975

[21] Appl. No.: 586,944

[52] U.S. Cl. ..... 182/145; 182/103; 182/142; 187/9 R

[51] Int. Cl.[2] ..... B66B 9/20

[58] Field of Search ..... 182/145, 141, 103, 102, 182/63, 146; 187/95, 9 E, 10, 11, 9 R

[56] References Cited

UNITED STATES PATENTS

| | | | |
|---|---|---|---|
| 2,059,150 | 10/1936 | Schroeder | 187/9 E |
| 3,329,240 | 7/1967 | Harwood | 187/95 |
| 3,891,062 | 6/1975 | Geneste | 182/103 |

*Primary Examiner*—Reinaldo P. Machado
*Attorney, Agent, or Firm*—Bailey, Dority & Flint

[57] ABSTRACT

Apparatus for aligning a work platform which is cantilevered outwardly and laterally on a carriage for movement up and down on parallel rails of an elevated tower is illustrated as including a pair of vertically spaced horizontal shafts carried by a first pair of wheels engaging an outside portion of a rail, each of said shafts having an adjustable eccentrically mounted wheel carrying portion with means for mounting the shaft in fixed position with respect to the carriage so that the eccentric portion of the shaft is in position to affect proper alignment for the wheels with respect to the rail to insure proper alignment of a second pair of vertically spaced wheels engaging an outside portion of the other rail.

2 Claims, 4 Drawing Figures

APPARATUS FOR ALIGNING A MOBILE LIFT WORK PLATFORM

BACKGROUND OF THE INVENTION

Various devices have been provided for raising a variety of work platforms but these have generally contemplated the use of hydraulically operated booms with the work platform in fixed position adjacent the free end thereof. Such work platforms are illustrated, for example, in United States Letters Patent Nos. 3,584,705 and 3,776,367. The work platform of the present invention is of a type which is cantilevered forwardly and laterally of a tower which may be raised and lowered. Rails are carried by the tower in parallel relation thereto for supporting the platform to be raised and lowered thereon by cables carried by each side of the carriage raising and lowering same. The wheels ae subjected to wear as the carriage moves repeatedly up and down the rails. Wear of these and any other of the parts associated with the movement between the carriage and the rails is multiplied since any resulting lateral play between the wheels and the rails is transmitted and multiplied due to the laterally extending portions of the platform being cantilevered therefrom. Any movement of the carriage as tilting from side to side as the workers move therealong is most disconcerting when working on the upper portions of multi-story buildings and the like.

SUMMARY OF THE INVENTION

It has been found that by employing a pair of wheels on each side of the carriage for engaging outer surfaces of the rails and by providing adjustable means for the wheels on at least one side of the carriage, adjustments may be made through the use of an eccentric wheel carrying shaft to adjust the alignment of the carriage within acceptable limits for movement up and down on the elongated parallel rails.

Accordingly, it is an important object of this invention to provide apparatus for aligning the carriage supporting such a work platform on the parallel rails to avoid swaying of the work platform from side to side to permit vertical movement thereof without binding the rails.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a work platform carried for movement up and down on elongated parallel rails longitudinally mounted on an upright tower wherein the work platform is cantilevered outwardly and laterally on each side of a carriage movable on the rails. A pair of vertically spaced wheels A are carried by the carriage on each outer side of the rails laterally thereof. A pair of transversely spaced flanges B are carried by the carriage adjacent each of at least one of the pairs of wheels. A member C bridges each pair of flanges remote from the carriage. A shaft D extends at right angles through each pair of flanges adjacent and in alignment with the bridging members. A wheel carrying extension E of the shaft is carried eccentrically of one end of each shaft. A threaded means F is carried by the bridging members engaging the shafts fixing them against rotation within the flanges. Thus, the threaded means may be disengaged from the shafts to rotate the shafts adjusting the spacing of respective wheels from the adjacent rail for maintaining proper alignment of the work platform on the elongated parallel rails.

Figure 1:
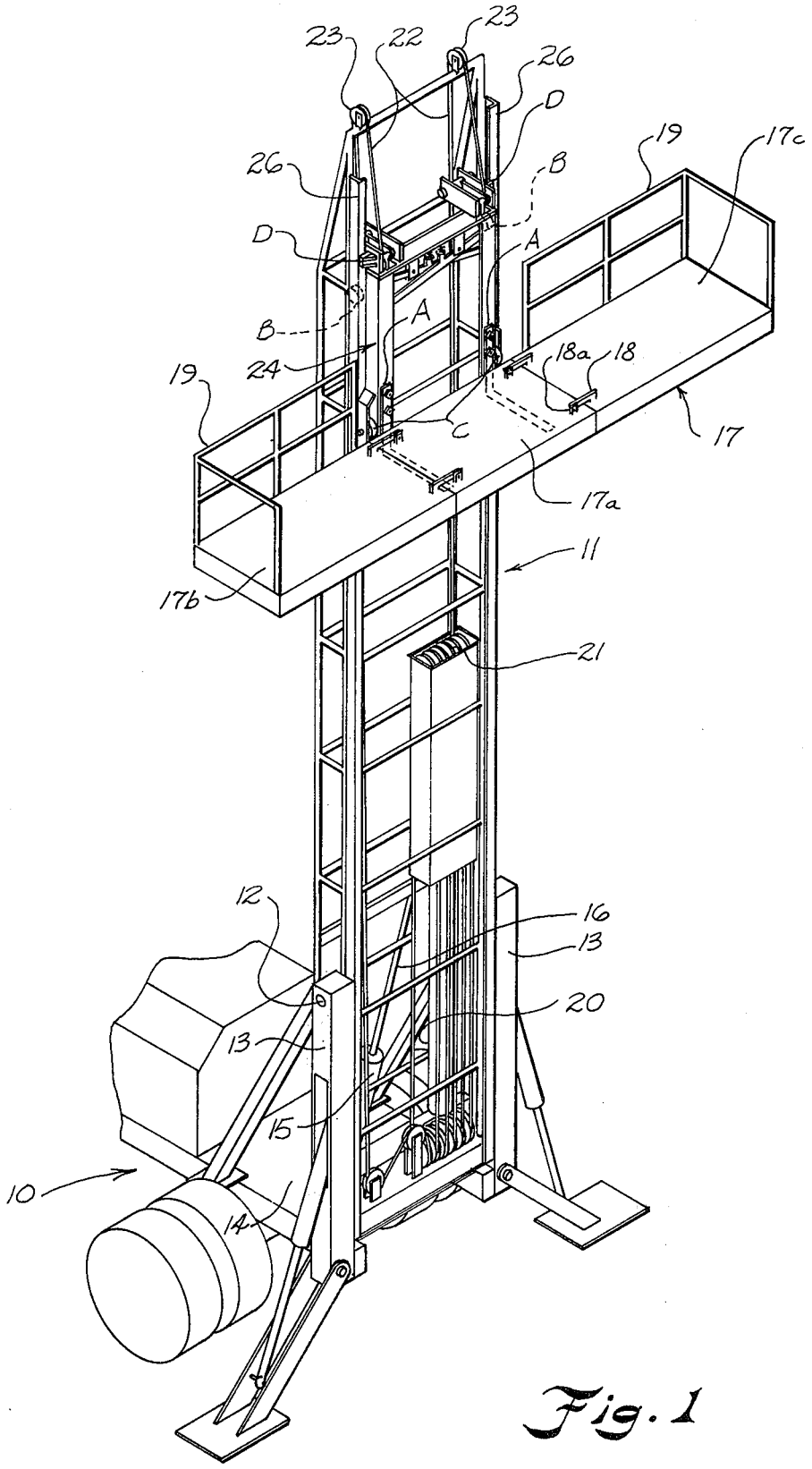
FIG. 1 is a perspective view illustrating a work platform positioned for movement on the rails of a tower with adjustment means constructed in accordance with the present invention.

A power operated wheeled vehicle broadly designated at 10 is illustrated in FIG. 1 for supporting a tower, broadly designated at 11. The tower 11 is pivotally connected as at 12 to each of a pair of spaced vertical standards 13 fixed adjacent their lower ends to a platform 14 of the wheeled vehicle. The platform 14 carries a hydraulic cylinder 15 which is pivotally connected on one end thereto while a piston rod 16 extends from the other end into pivotal engagement with the tower 11 for raising same as from a substantially horizontal position to the substantially vertical position illustrated in FIG. 1. A work platform is broadly designated at 17 and includes an outwardly extending center section **17*a* with sections 17*b* and 17*c* hingedly carried by respective sides thereof. A suitable railing 19 is provided about each of the hinged platform sections 17*b* and 17*c*** for acting as guard rails for the workers carried on the work platform.

The work platforms of the present invention are of the type used as a substitute for scaffolding employed in the construction trade by such artisans as masonry workers, painters and the like.

A cylinder 20 is illustrated in FIG. 1 as being fixed adjacent its lowered end with respect to the tower 11. The cylinder 20 operates through a block and tackle arrangement 21 to multiply the cylinder's effectiveness in raising and lowering cable means 22 positioned adjacent opposite sides of the tower 11. The cable means 22 are carried by sheaves 23 positioned adjacent the upper free end of the tower 11. The work platform 17 is carried on a platform carriage broadly designated at 24. Referring especially to FIG. 1, it will be noted that the platform carriage 24 includes a pair of spaced parallel angle irons 25 carried in alignment with the vertical rails 26 of the tower. The platform carriage is bridged transversely adjacent the top by a plate 27 and adjacent the lower portion thereof by a bar 28.

The platform 17 may be secured to the carriage 24 as by the use of angle irons 29. A vertical leg of the angle irons may be secured as by bolts 30 to a transverse web of the aligned angle irons 25.

At least on one side of the carriage 24 on an outer surface of the longitudinal leg of the angle iron 25, a pair of longitudinally spaced wheels A are carried by the carriage laterally thereof. By ajusting the upper and lower of this pair of wheels, the entire carriage may be aligned with respect to the vertical parallel rails 26.

Figure 2:
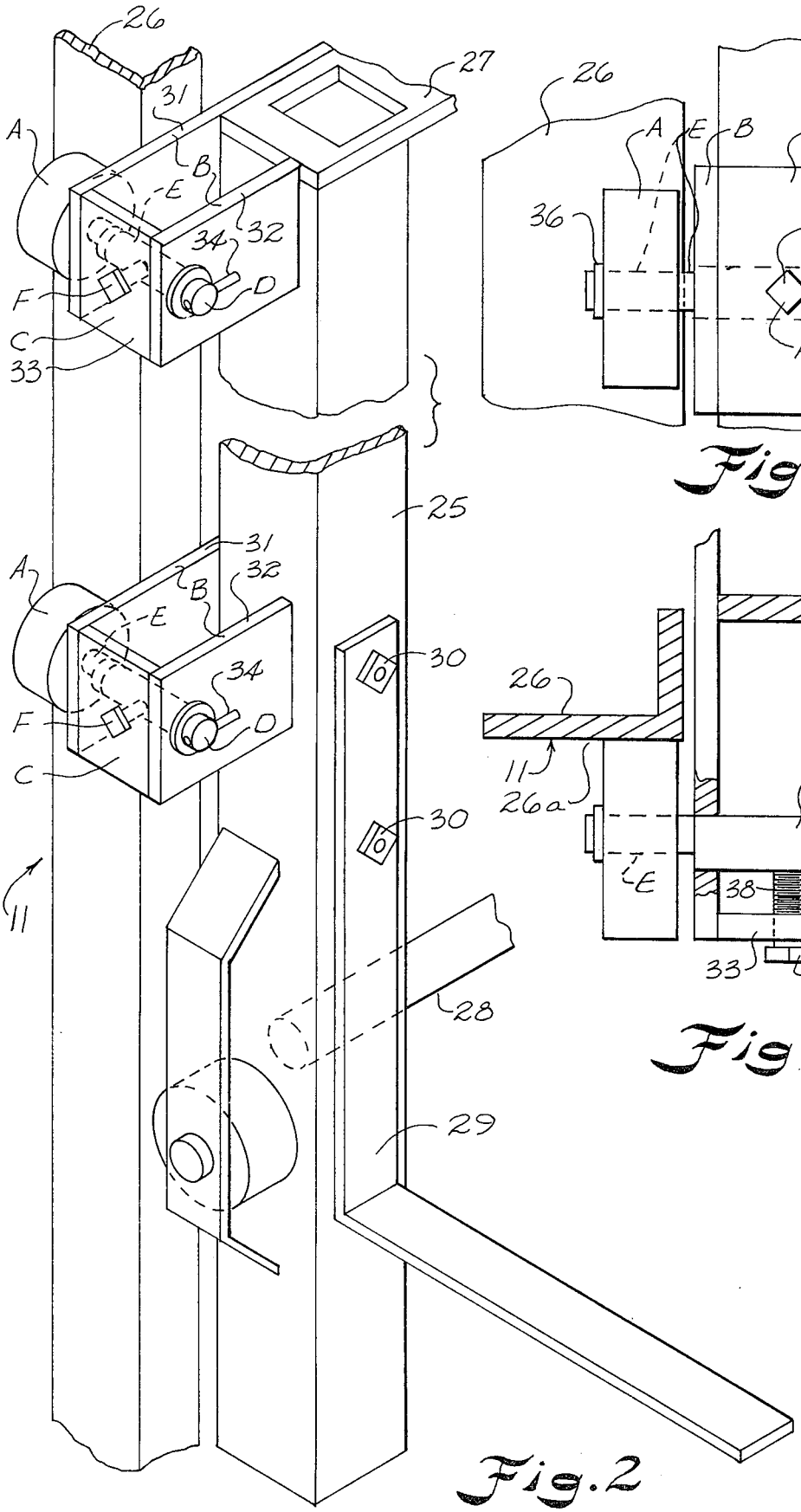
FIG. 2 is an enlarged perspective view, with parts omitted and parts in section, further illustrating a left hand portion of the carriage and rail including an adjustment assembly constructed in accordance with the invention.

A pair of transversely spaced flanges B are carried by the carriage adjacent each of the said at least one pair of wheels. The tranversely spaced flanges are designated at 31 and 32, respectively. A member C bridges each of the flanges 31 and 32 and is illustrated in FIG. 2 as being in the form of a vertical plate 33. A shaft D extends at right angles through each pair of flanges 31 and 32 adjacent and in alignment with the plate 33 of the bridging member C.

A wheel carrying extension E of the shaft is carried eccentrically of one end of each shaft. Each end of the shaft D is journaled in respective flanges 31 and 32 and is secured against the longitudinal movement by means of the press fit spring pin or roll 34 received within the transverse bore 34*a* within the shaft D. If desired, a washer 35 may be utilized to space the pin 34 for engaging same utilizing any suitable tool, such as a short section of pipe, to rotate the shaft D. The wheel A is illustrated as being retained on the reduced eccentric portion E as by the snap ring 36. The pin 34 also serves as an indicator for indexing said shaft. In the extreme right hand position shown in the drawings the wheel is closest to the rail 26 and if turned to extreme left hand position the wheel would be at a maximum distance from the rail. Intermediate positions would also give a relative indication of the position of the wheel. The wheel of course, may contain suitable bearings, not shown.

Figure 3:
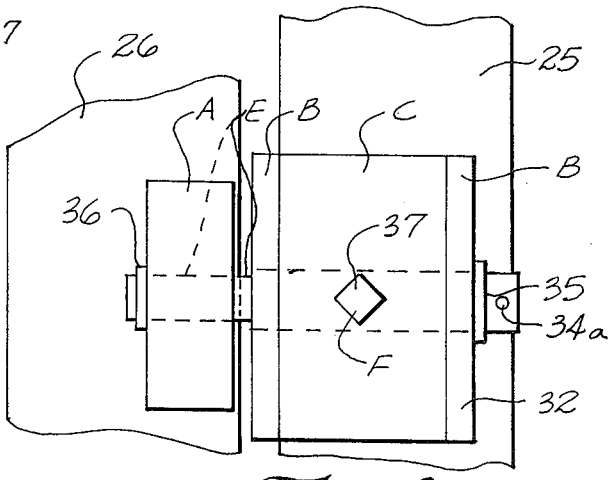
FIG. 3 is an enlarged front elevation of a wheel assembly looking from the left hand side in FIG. 2.
Figure 4:
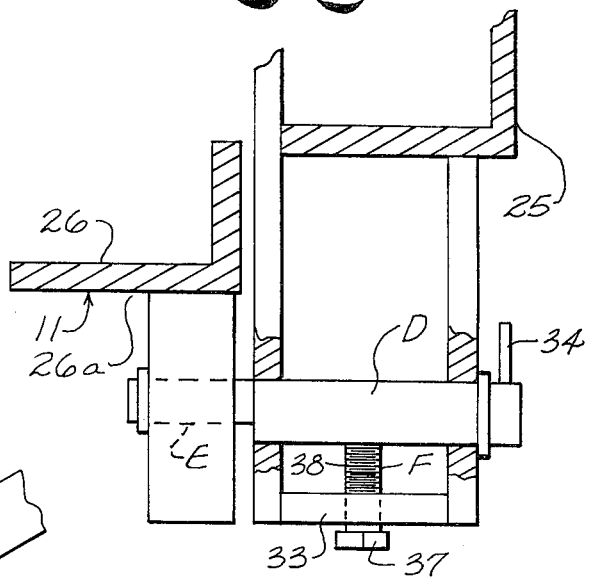
FIG. 4 is an enlarged top plan view of a wheel assembly.

A threaded means F is carried by the bridge member 33 and includes a head 37 and a threaded shank portion 38 (FIGS. 3 and 4). The threaded means F may be withdrawn from engagement with the shaft D by turning the head 37 as by a wrench. By then engaging the outer end of the shaft D and by turning same, the eccentric wheel carrying extension E of the shaft may be positioned so that the associated wheel may be properly aligned with the outer surface 26*a* of the rail 26.

While a preferred embodiment of the invention has been described using specific terms, such description is for illustrative purposes only, and it is to be understood that changes and variations may be made without departing from the spirit or scope of the following claims.

What is claimed is:

1. In a work platform carried for movement up and down on parallel rails longitudinally mounted on an upright tower wherein the work platform is cantilevered laterally on a carriage on each side thereof movable on said rails, the improvement including:

A. a pair of vertically spaced wheels carried by said carriage on each outer side of said rails laterally thereof;

B a pair of transversely spaced flanges carried by said carriage adjacent each of a pair of said wheels;

C. a member bridging each pair of said flanges;

D. a shaft extending at right angles through each of said pairs of flanges adjacent and in alignment with said bridging members;

E. a wheel carrying extension of said shaft carried eccentrically of one end of said shaft; and F. a threaded means carried by said bridging members engaging said shafts fixing said shafts against rotation within said flanges;

whereby said threaded means may be disengaged from said shafts to adjust the spacing of said wheels from the adjacent rail.

2. The structure set forth in claim 1 including a pin extending transversely outwardly of said shaft for indexing, turning and retaining said shaft.

* * * * *